United States Patent [19]

Zabelka

[11] Patent Number: 4,493,291

[45] Date of Patent: Jan. 15, 1985

[54] GAS COOLER ARRANGEMENT

[75] Inventor: Jaroslav Zabelka, Winterthur, Switzerland

[73] Assignee: Sulzer Brothers Limited, Winterthur, Switzerland

[21] Appl. No.: 421,313

[22] Filed: Sep. 22, 1982

[30] Foreign Application Priority Data

Oct. 26, 1981 [CH] Switzerland ..... 6812/81

[51] Int. Cl.[3] ..... F22D 1/00

[52] U.S. Cl. ..... 122/7 R; 48/67; 122/5; 122/6 A

[58] Field of Search ..... 122/32, 33, 6 A, 5, 122/7 R; 48/67, 77, 63, 64

[56] References Cited

U.S. PATENT DOCUMENTS

| | | | |
|---|---|---|---|
| 4,090,473 | 5/1978 | Golovanov | 122/6 A |
| 4,328,007 | 5/1982 | Rafael | 122/5 X |
| 4,377,132 | 3/1983 | Koog et al. | 48/67 X |
| 4,377,394 | 3/1983 | Muenger | 122/5 X |

*Primary Examiner*—Edward G. Favors

*Attorney, Agent, or Firm*—Kenyon & Kenyon

[57] ABSTRACT

The gas cooler arrangement includes a first pressure vessel in which heat is yielded by radiation and a following convection gas cooler. The pressure vessel of the convection gas cooler includes a faller flue and at least one riser flue for cooling the gas. The flues comprise heat-removing tubes which are parts of a steam generator. The bottom of the pressure vessel contains an ash collection chamber which is connected to the ends of the flues and which can be emptied via a suitable closure element.

14 Claims, 3 Drawing Figures

1
2
3
4
5
6
10
11
8
9
15
14
14'
62(63)
50
75
48
49
45
47
41
53 (52)
72
23
21
II
II
20
44
40
52
60
28
26
73
30
31

76
75
47
41
45
32
33
21
44
62
40
58
60

III
72
70
53
26
58
55
62
60
24
37
32
23
I
I
34
38
33
35
25
59
56
63
61
52
71
74
III

GAS COOLER ARRANGEMENT

This invention relates to a gas cooler arrangement. More particularly, this invention relates to a gas cooler arrangement for a coal gasification plant.

Heretofore, various types of gas cooler arrangements have been known for the cooling of the reaction products of a coal gasification reactor. For example, as described in U.S. Pat. No. 4,328,007 and German O.S. No. 29 33 716, one known arrangement includes a pressure vessel which is provided with an axial downcomer chamber having a cylindrical radiant cooling wall on an axis parallel to the downcomer axis. In addition, the pressure vessel includes an annular riser chamber which is bounded by cooling surfaces and which extends around the downcomer chamber. The riser chamber is also connected at the top to at least one convection gas cooler which is disposed in a cylindrical pressure tank having a vertical axis. During operation, this convection gas cooler is flowed through continuously and downwardly. Depending upon the quality and particle size of the coal to be gasified, the proportion of ash particles which are separated in and discharged from the gas cooler varies. The remainder of the ash particles thus flows to the convection gas cooler. As a result, some of the ash particles become deposited on the tubes of the convection gas cooler while the majority of the ash particles are discharged together with the gas flow from the convection gas cooler. As a result, a special separating means is required in order to separate these particles from the gas flow. However, this separating means introduces an additional pressure drop on the gas side.

Accordingly, it is an object of the invention to provide a gas cooler arrangement which is able to separate out particles from a flowing gas stream.

It is another object of the invention to provide a gas cooler arrangement which utilizes a minimal pressure drop in order to separate out particles from a flowing gas stream.

It is another object of the invention to provide a gas cooler arrangement of relatively simple construction.

Briefly, the invention provides a gas cooler arrangement for a coal gasification plant. The arrangement comprises a first pressure vessel having a peripheral radiant cooling wall defining an axial downcomer chamber for receiving a flow of particle-laden gas and a surrounding cooling surface about the cooling wall to define an annular riser chamber therebetween. In addition, the arrangement includes a convection gas cooler which is connected at an upper end to a top of the annular riser chamber. This cooler also includes a vertically disposed second pressure vessel, a faller flue composed of heat-removing tubes, at least one riser flue composed of heat-removing tubes and an ash chamber connected to the flues at a bottom end of the second pressure vessel.

The construction of the gas cooler arrangement is such as to provide an improved use of the space available while also providing a reduced gas pressure drop.

The cooler arrangement also includes a closure element which is connected to the ash chamber for removal of separated particles.

In order to prevent clogging of the flow cross-sections by the ash particles, the tubes of at least the faller flue are interconnected to form vertical tube banks, i.e. tube banks which extend in the flow direction.

Each flue is constructed to have parallel rows of tubes defining the flow cross-sections. However, since the gas in the faller flue contains more ash particles than the gas in the riser flue, the risk of the flow cross-section becoming clogged is greater in the faller flue than in the riser flue. In order to reduce this risk, the tube rows of the faller flue are spaced apart a greater distance than the rows of the riser flue.

In order to obviate any bypass flows, each flue is made of rectangular cross-section with gas tight boundary walls. Further, by welding the heat-removing tubes together to form tube banks, structures are provided which have a reduced tendency to vibrate. Further, the boundary walls of the faller flue may be provided with vertical evaporator tubes with webs interconnecting the evaporator tubes in gas tight manner. This helps to reduce considerably substantial temperature differences and correspondingly high thermal stressing. In addition, the boundary walls of the riser flue may be disposed to encompass the boundary walls of the faller flue. This will eliminate any need for connections between the riser flue walls and the faller flue walls, thus, thermal stressing at such connections are obviated.

The convection gas cooler may also be constructed so that the riser flue and the pressure vessel define a downcomer passage for receiving a cooled gas from the riser flue in order to cool the pressure vessel. In this case, an exit connection is made at the bottom of the pressure vessel to communicate with the downcomer passage. These features serve to make the temperatures uniform in the pressure vessel.

In order to provide a very simple construction which can be readily fabricated, the tubes in at least one of the flues are disposed in parallel to the longitudinal axis of the pressure vessel of the convection gas cooler. In addition, the tubes of at least the riser flue can be disposed in a meandering or serpentine fashion in order to improve the heat transfer coefficient without any great risk of soiling. However, if soiling occurs with extreme coal qualities, gaps can be formed in the riser flue for passage of suitable tube cleaning means therethrough.

The convection gas cooler may be provided with supply lines and exhaust lines for supplying and exhausting a working medium to and from the tubes of the flues near the top of the pressure vessel. At the same time, expansion loops can be provided in the tubes near the bottom end of the pressure vessel. In this case, the working medium may be caused to flow through the tubes from the supply lines in countercurrent to the gas flow. This provides a satisfactory thermo-dynamic effect and an easy-to-service arrangement.

The convection gas cooler may also have a gas entry connection to the faller flue and a gas exit connection to the riser flue disposed at a top of the pressure vessel. In addition, the pressure vessel can be provided with separating flanges below these connections in order to permit disengagement of the top of the pressure vessel along with the connections from the remainder of the vessel. This facilitates a very simple operation of the arrangement.

These and other objects and advantages of the invention will become more apparent from the following detailed description taken in conjunction with the accompanying drawings wherein.

Figures 1, 2, 3:
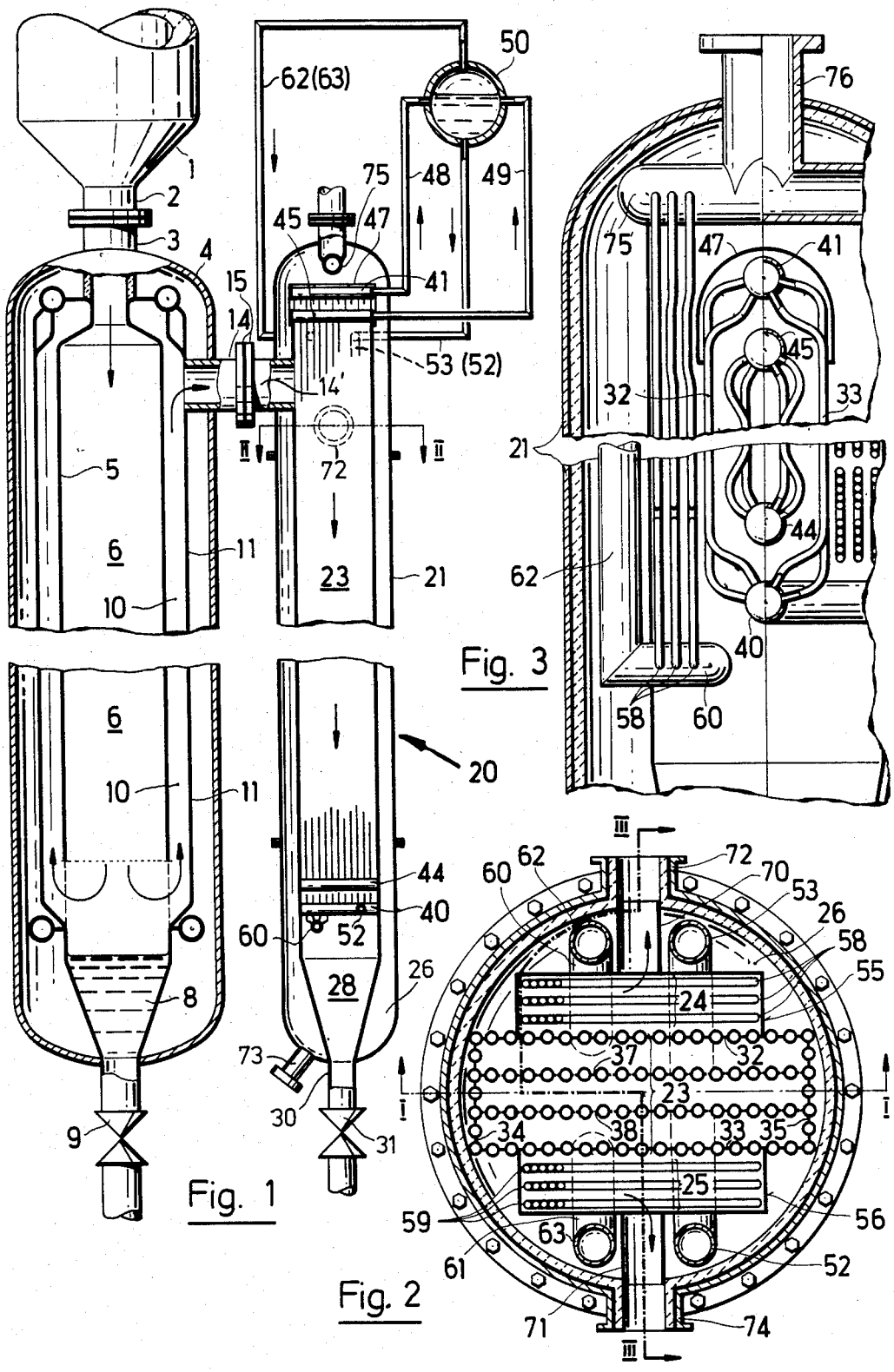
FIG. 1 illustrates a diagrammatic vertical sectional view through a gas cooler arrangement constructed in accordance with the invention.
FIG. 2 illustrates a view taken on line II—II of FIG. 1.
FIG. 3 illustrates a vertical sectional view through a top zone and bottom zone of a convection gas cooler taken along line III—III of FIG. 2.

Referring to FIG. 1, a gas cooler arrangement is constructed to receive a flow of hot particle-laden gas, for example from a coal gasification reactor 1 having a downwardly directed spigot 2. As indicated, the gas cooler arrangement includes a cylindrical pressure vessel 4 which has an upstanding spigot 3 connected to the spigot 2 of the reactor 1.

The pressure vessel 4 is constructed with a cylindrical radiant cooling wall 5 which defines an axial downcomer chamber 6 for receiving and cooling a gas from the reactor 1. In addition, a waterbath 8 is provided at the bottom end of the downcomer chamber 6 and waste is removed from the bottom of the waterbath via a delivery member 9, for example a valve which can be opened and closed from time-to-time. In addition, a cylindrical cooling surface 11 is concentrically disposed about the cooling wall 5 to define an annular riser chamber 10 therebetween. The cooling wall 5 is formed with orifices or openings closely above the waterbath 8 in order to communicate the downcomer chamber 6 with the riser chamber 10. This permits the cooled gas to flow upwardly into the riser chamber 10.

The details of the pressure vessel having an axial downcomer chamber and waterbath are described, for example in U.S. Pat. No. 4,395,268.

The gas cooler arrangement also has a convection gas cooler 20 connected at an upper end to a top of the annular riser chamber 10 in order to receive cooled gas therefrom. To this end, the cooling surface 11 is connected with a spigot 14 which extends through the pressure vessel 4 to abut a similar spigot 14' of the convection gas cooler 20. As shown, the two spigots are connected via suitable flanges 15.

The convection gas cooler 20 includes a vertically disposed pressure vessel or tank 21 in which a faller flue 23 is vertically disposed. The faller flue 23 is in communication with the spigot 14' in order to receive the cooled gas from the riser chamber 10 of the pressure vessel 4. In addition, the gas cooler 20 has two riser flues 24, 25 within the pressure vessel 21. These flues 23, 24, 25 are surrounded by a somewhat annular chamber 26. All of the flues 23–25 are interconnected at the bottom ends by a funnel shaped deflecting chamber 28; the bottom end 30 of which extends to a shut-off element 31, such as a valve, for removal of separated particles.

Referring to FIG. 2, the faller flue 23 has four boundary walls 32, 33, 34, 35 and is subdivided into three equally wide chambers by two partitions 37, 38. All of the boundary walls 32–35 and the partitions 37, 38 are formed of vertically disposed tubes which are welded together in gas tight manner via webs. For example, the partitions 37, 38 are formed of finned tubes which are welded together in certain places and which can each be bent out for lateral support onto the respective longer side walls 32, 33 and welded thereto. As indicated in FIG. 3, the tubes of the faller flue 23 are interconnected to form vertical tube banks.

As indicated in FIGS. 1 and 3, the tubes of the boundary walls 32–35 are connected to a bottom distributor or main 40 and a top collector 41 while the tubes of the partitions 37, 38 start from a main 44 and extend to a collector 45. As indicated in FIG. 3, the tubes are not connected in gas tight manner in a top zone. In addition, a gas tight hood 47 covers the collector 41 and the tubes extending thereto. This hood 47 is sealingly connected all the way around to the boundary walls 32–35 approximately at the height of the collector 45.

As indicated in FIG. 1, exhaust lines 48, 49 extend from the collectors 41, 45 through the hood 47 to a drum 50 of a steam generator. In addition, a pair of lines 52, 53 are connected to the base of the drum 50 and extend into and through the annular chamber 26 of the pressure vessel 21 to the mains 40, 44, respectively.

Referring to FIG. 2, each of the riser flues 24, 25 have boundary walls formed by U-shaped wall plates 55, 56 which are connected in substantially gas tight manner to the outside surfaces of the long walls 32, 33 of the faller flue 23. As indicated, three tube banks 58, 59 are suspended in each of the riser flues 24, 25. Each of these tube banks 58, 59 is formed by five meandering or serpentine tubes which extend over the entire and relatively large horizontal extent of the riser flues 24, 25. These tubes are further connected at the bottom to two wet steam mains 60, 61 which, in turn, communicate via a respective line 62, 63 with the steam chamber of the drum 50 (see FIG. 1).

The spigot 14' which connects the gas cooler 20 to the pressure vessel 4 passes through the short wall 34 of the faller flue 23. In addition, metal walls are connected to the flue walls at the bottom end of the faller flue 23 and the riser flues 24, 25 in a funnel shape manner along a cruciform contour to define a deflecting chamber 28. At the bottom of the vessel 21 is provided a spigot 73 forming an exit for the chamber 26.

Referring to FIG. 2, horizontal spigots or the like 70, 71 extend from the riser flues 24, 25 to internally insulated exit spigots or the like 72, 74 of the pressure vessel 21. The top ends of the tubes which form the two banks 58, 59 are connected to a collector 75 (see FIG. 2) which, in turn, is connected to an axial spigot 76 at the top of the pressure vessel 21.

The gas cooler arrangement operates as follows:

Gas discharging from the reactor 1 and containing particles of ash and slag flows through the downcomer chamber 6 with the temperature of the gas decreasing from approximately 1450° Centigrade to approximately 1000° Centigrade. In doing so, the particles in the gas solidify and become non-sticky. Most of the particles then drop into the waterbath 8 and are quenched. The remaining particles flow with the gas into and through the riser chamber 10 and issue therefrom at a temperature of, for example 650° Centigrade, into the faller flue 23 of the convection gas cooler 20.

After flowing through the faller flue 23, the gas is deflected into riser flues 24, 25 at a temperature of approximately 450° Centigrade. Most of the particles of ash and slag still present are then hurled into the funnel of the deflecting chamber 28.

The gas which rises in the riser flues 24, 25 is further cooled and issues through the spigots 72, 74 from the cooler 20 either for direct use as a gas for combustion or a process gas or to another cooler which can be connected before the drum 50 as an economizer.

During operation, the working medium of the steam generator passes from the drum 50 through the lines 52, 53 into the mains 40, 44 and thence into the tube banks of the boundary walls 32–35 and the partitions 37, 38 respectively in which there is at least some evaporation. Thereafter, the working medium passes to the collectors 41, 45 and thence via the lines 48, 49 to the drum 50 where separation of water from the steam occurs. The working medium then flows as saturated steam through the lines 62, 63 to the mains 60, 61 and therefrom through the meandering tubes of the tube banks 58, 59 in which the medium is superheated. The superheated steam is then passed to the collector 75 and from there through the exhaust spigot 76 (see FIG. 2). The steam which is exhausted may pass to an after-superheater or directly for use either for propulsion in a thermal power plant or as process steam in a chemical works.

It is to be noted that various modifications may be made in the construction of the gas cooler arrangement. For example, the number of tubes which make up the discrete heating surfaces, the proportion of tubes for the faller flue 23 and riser flues 24, 25, the number of tube banks 58, 59 and the number of tubes may vary as required from the values specified. Further, it may be convenient for the metal walls 55, 56 to be connected to the sidewalls 32, 33 by way of sliding seals. Also, the walls 55, 56 may be provided with expansion folds or may be interconnected around the faller flue 23 so that connections to the sidewalls 32, 33 become unnecessary. The walls 55, 56 may also be insulated.

Of note, the number of riser flues is not limited. However, a symmetrical arrangement is conveniently used.

Of note, suitable tube cleaning means, such as soot blowers, ball rain facilities and knocking devices, can be readily received in the relatively wide chambers of the faller flue 23. To this end, gaps or spaces may be provided between the arms of the meandering riser flue tubes to facilitate passage of the tube cleaning means.

Referring to FIG. 2, as shown, the parallel rows of tubes defining the walls 32, 33 and the partitions 37, 38 are spaced apart a greater distance than the rows of tubes 58, 59 of the riser flues 24, 25. Since the gas in the faller flue 23 contains more ash particles than the gas in the riser flues 24, 25.

The invention thus provides a gas cooler arrangement which occupies a relatively compact space. To this end, the use of space in the convection gas cooler is more efficient than in a gas cooler having only a single downcomer. Further, the pressure drop on the gas side is less since there is no need for the convection gas cooler to have a special separating means connected after the gas exit.

What is claimed is:

1. A gas cooler arrangement for a coal gasification plant, said arrangement comprising a first pressure vessel having a peripheral radiant cooling wall defining an axial downcomer chamber for receiving a flow of particle-laden gas and a surrounding cooling surface about said wall defining an annular riser chamber therebetween; and a convection gas cooler connected at an upper end to a top of said annular riser chamber, said cooler including a vertically disposed second pressure vessel, a faller flue composed of vertically disposed heat-removing tubes, at least one riser flue composed of heat removing tubes, and an ash chamber connected to said flues at a bottom end of said second pressure vessel.

2. A gas cooler arrangement as set forth in claim 1 which further comprises a closure element connected to said ash chamber for removal of particles therefrom.

3. A gas cooler arrangement as set forth in claim 1 wherein said tubes of at least said faller flue are interconnected to form vertical tube banks.

4. A gas cooler arrangement as set forth in claim 1 wherein each flue is of rectangular cross-section and has gas-tight boundary walls.

5. A gas cooler arrangement as set forth in claim 4 wherein said boundary walls of said faller flue include vertical evaporator tubes and webs interconnecting said evaporator tubes in gastight manner.

6. A gas cooler arrangement as set forth in claim 4 wherein said boundary walls of said riser flue encompasses said boundary walls of said faller flue.

7. A gas cooler arrangement as set forth in claim 1 wherein said tubes in at least one of said flues are parallel to a longitudinal axis of said second pressure vessel.

8. A gas cooler arrangement as set forth in claim 1 wherein said tubes of at least said riser flue are disposed in serpentine fashion.

9. A gas cooler arrangement as set forth in claim 8 wherein said tubes of said riser flue are disposed to form gaps for passage of tube cleaning means therethrough.

10. A gas cooler arrangement for receiving a flow of hot particle-laden gas, said arrangement comprising a first pressure vessel having a peripheral radiant cooling wall defining an axial downcomer chamber for receiving and cooling the gas, and a surrounding cooling surface about said wall defining an annular riser chamber therebetween, said riser chamber being in communication with said downcomer chamber to receive cooled gas therefrom; and a convection gas cooler connected at an upper end to a top of said annular riser chamber to receive the cooled gas therefrom, said cooler including a vertically disposed second pressure vessel, a faller flue within said second pressure vessel for receiving the cooled gas and having vertically disposed heat-removing tubes for further cooling the cooled gas, at least one riser flue within said second pressure vessel for receiving the gas from said faller flue and having heat-removing tubes for still further cooling of the gas, and a chamber below said flues to receive particles separated from the flues.

11. A gas cooler arrangement for a coal gasification plant, said arrangement comprising a first pressure vessel having a peripheral radiant cooling wall defining an axial downcomer chamber for receiving a flow of particle-laden gas and a surrounding cooling surface about said wall defining an annular riser chamber therebetween; and a convection gas cooler connected at an upper end to a top of said annular riser chamber, said cooler including a vertically disposed second pressure vessel, a faller flue composed of heat-removing tubes, at least one riser flue composed of heat removing tubes, each said flue having parallel rows of said tubes with said tube rows of said faller flue being spaced apart a greater distance than said tube rows of said riser flue and an ash chamber connected to said flues at a bottom end of said second pressure vessel.

12. A gas cooler arrangement for a coal gasification plant, said arrangement comprising a first pressure vessel having a peripheral radiant cooling wall defining an axial downcomer chamber for receiving a flow of particle-laden gas and a surrounding cooling surface about said wall defining an annular riser chamber therebetween; and a connection gas cooler connected at an upper end to a top of said annular riser chamber, said cooler including a vertically disposed second pressure vessel, a faller flue composed of heat-removing tubes, at least one riser flue composed of heat removing tubes, said riser flue and said second pressure vessel defining a downcomer passage therebetween for receiving a cooled gas from said riser flue for cooling of said pressure vessel, an exit connection at abottom of said second pressure vessel in communication with said downcomer passage, and an ash chamber connected to said flues at a bottom end of said second pressure vessel.

13. A gas cooler arrangement for a coal gasification plant, said arrangement comprising a first pressure vessel having a peripheral radiant cooling wall defining an axial downcomer chamber for receiving a flow of particle-laden gas and a surrounding cooling surface about said wall defining an annular riser chamber therebetween; and a convection gas cooler connected at an upper end to a top of said annular riser chamber, said cooler including a vertically disposed second pressure vessel, a faller flue composed of heat-removing tubes, at least one riser flue composed of heat removing tubes, an ash chamber connected to said flues at a bottom end of said second pressure vessel, supply lines for supplying a working medium to said tubes of said flues near a top of said second pressure vessel, exhaust lines for exhausting the working medium from said tubes of said flues near said top of said second pressure vessel and expansion loops in said tubes near said bottom end of said second pressure vessel whereby the working medium flows through said tubes from said supply lines in countercurrent to the gas flow.

14. A gas cooler arrangement for a coal gasification plant, said arrangement comprising a first pressure vessel having a peripheral radiant cooling wall defining an axial downcomer chamber for receiving a flow of particle-laden gas and a surrounding cooling surface about said wall defining an annular riser chamber therebetween; and a convection gas cooler connected at an upper end to a top of said annular riser chamber, said cooler including a vertically disposed second pressure vessel, a faller flue composed of heat-removing tubes, at least one riser flue composed of heat-removing tubes, an ash chamber connected to said flues at a bottom end of said second pressure vessel, a gas entry connection to said faller flue and a gas exit connection to said riser flue disposed at a top of said second pressure vessel, and separating flanges in said second pressure vessel below said connections to permit disengagement of said to of said second pressure vessel with said connections from the remainder of said second pressure vessel.

* * * * *